US007648381B2

(12) United States Patent
Wehrle et al.

(10) Patent No.: US 7,648,381 B2
(45) Date of Patent: Jan. 19, 2010

(54) ELECTRICAL PLUG CONNECTOR PART

(75) Inventors: Gerhard Wehrle, Donaueschingen (DE); Paul Rudolph, Stuttgart (DE)

(73) Assignee: Coninvers GmbH, Herrenberg (DE)

( * ) Notice: Subject to any disclaimer, the term of this patent is extended or adjusted under 35 U.S.C. 154(b) by 0 days.

(21) Appl. No.: 12/060,326

(22) Filed: Apr. 1, 2008

(65) Prior Publication Data

US 2008/0248674 A1 Oct. 9, 2008

(30) Foreign Application Priority Data

Apr. 4, 2007 (DE) ..... 20 2007 005 029 U

(51) Int. Cl.
*H01R 4/38* (2006.01)

(52) U.S. Cl. ..... 439/321

(58) Field of Classification Search ..... 439/312, 439/313, 321, 320, 318
See application file for complete search history.

(56) References Cited

U.S. PATENT DOCUMENTS 4,165,910 A * 8/1979 Anderson ..... 439/318
4,588,245 A * 5/1986 Schwartz et al. ..... 439/312

FOREIGN PATENT DOCUMENTS

DE 197 21 506 11/1998
DE 200 11 605 U 1 11/2000
DE 102 24 000 12/2003
EP 0 218 060 A1 8/1986

* cited by examiner

*Primary Examiner*—Phuong K Dinh
(74) *Attorney, Agent, or Firm*—Renner, Otto, Boisselle & Sklar, LLP

(57) ABSTRACT

An electrical plug connector part with a locking nut that is rotatable relative to the plug body and can be screwed onto an associated matching plug part and that is secured against unintentional rotation relative to the plug body by matched latch elements, wherein first latch elements are rigid and are molded onto the locking nut, and corresponding second latch elements are mounted rotation-proof and with spring action on the plug body. The locking nut and the plug body of the plug connector part have an equal number N of first and second latch elements that are spaced from each other and are arranged in sequence in circumferential direction, with the first latch elements being located on an inner circumference of the locking nut, and the second latch elements being located on an outer circumference of the plug body. The spacing of the first latch elements is different than that of second latch elements. The N first and second latch elements do not follow each other directly, with the first latch elements specifically not forming a locking ring gear.

9 Claims, 2 Drawing Sheets

ELECTRICAL PLUG CONNECTOR PART

CROSS-REFERENCE TO RELATED APPLICATION

The present application claims priority under 35 U.S.C. §119 to German Patent Application No. 20 2007 005 029.1, filed on Apr. 4, 2007, the entire disclosure of which is incorporated herein by reference.

TECHNICAL FIELD OF THE INVENTION

The invention relates to an electrical plug connector part with a locking nut that is rotatable relative to the plug body and can be screwed onto an associated matching plug part and that is secured against unintentional rotation relative to the plug body by matched latch elements, wherein first latch elements are rigid and are molded onto the locking nut, and corresponding second latch elements are mounted rotation-proof and with spring action on the plug body.

DESCRIPTION OF THE RELATED ART

Plug connectors with a locking nut for screwing onto a matching plug part, in particular for preventing unintentional disconnection of the plug connection, are known in a wide variety of embodiments. DE 197 21 506 C2 and DE 102 24 000 B4 are cited as examples.

DE 197 21 506 C2 discusses an electrical plug connector part with a clamping nut that is rotatable relative to the plug body and with a rotation lock for the clamping nut that is formed by a locking ring gear and a latch element. The locking ring gear is provided on the inner circumference of the clamping nut, and the latch element on the outer circumference of the plug body. The latch element is mounted rotation-proof on the plug body and has one or several latching teeth pointing radially outward. The at least one latching tooth engages the locking ring gear, and between the plug body and the clamping nut, a sleeve is provided that has an opening for the latching tooth.

DE 102 24 000 B4 teaches an electrical plug connector part with a locking nut that is rotatable relative to a contact carrier and is protected against unintentional turning by a rotation lock, with the rotation lock having a ring gear located on the locking nut and a latch ring fixed on the contact carrier. On the latch ring, at least two integrated spring elements are provided that carry a latch projection that works together with the ring gear. In terms of the circumference, the latch projections are spaced at an angle of less than 180°.

In known plug connector parts, the locking nut configured as a clamping nut is frequently made of metal in order to connect the shield of a shielded cable in an electrically conducting way with the matching plug part. Usually, the contact carrier and/or the plug body are made of a synthetic material whose spring characteristics are insufficient for creating a latch element with spring-back action. Also, equipping a locking nut with a locking gear ring on its inner circumference makes it costly to manufacture, especially in the case of a metallic clamping nut, thereby raising the costs which is a disadvantage.

SUMMARY OF THE INVENTION

The invention addresses the problem of proposing an electrical plug connector part with a rotation lock for the locking nut of the type referred to above, where the rotation lock is easy to manufacture and install and ensures a permanent, safe and cost-effective vibration-proof connection of the plug body and the locking nut.

According to the invention, the locking nut and the plug body have an equal number N of first and second latch elements that are spaced apart from each other and are arranged in sequence in a circumferential direction. The first latch elements are located on an inner circumference of the locking nut, and the second latch elements are located on an outer circumference of the plug body. The first latch elements of the locking nut are spaced differently than the second latch elements of the plug body.

The N first and the second latch elements that have complementary shapes do not follow each other directly. Specifically, the first latch elements on the locking nut do not form a locking ring gear. The maximum number N of the first and second latch elements depends essentially on the size of the plug connector part. Depending on the number N of the latch elements, more or fewer latching positions may be determined that are preferably spaced at the same angle in a circumferential direction. It is expedient to provide at least three latch elements each on the locking nut and on the plug body in order to provide a sufficient number of latch positions.

Advantageously, the first and the second latch elements are distributed over their respective circumferential surfaces in such a way that, depending on the position of the locking nut relative to the plug body, no more than one first and one second latch element face each other.

The latch positions are those positions in which one first and one second latch element face each other. In the latch position, the first and the second latch elements interact. They are then mutually engaged and secure the locking nut against unintentional turning in relation to the plug body. In order to disengage the rotation lock, a torque that is dependent on the spring characteristics of the latch elements needs to act on the locking nut. Between the latch positions, other positions are possible in which the first and second latch elements are staggered in relation to each other, with the springy latch elements being pressed against the inner circumference of the locking nut by the plug body. Their prevention of a rotation of the clamping nut is less than positive.

Preferably, the N latch elements of the locking nut and of the plug body determine (N×N) latch positions of the plug connector that have the same angular distance of [360°/(N×N)] from each other. For example, three latch elements each on the locking nut and on the plug body determine 9 latch positions, and four latch elements each determine 16 latch positions. Here, the latch positions are equally distributed over the circumference of the locking nut and the plug body, respectively, with the nine latch positions staggered at an angle of 40°, and the 16 latch positions staggered at an angle of 22.5°. It can be seen that the number of latch positions grows exponentially with the number of the latch elements that are provided.

In an advantageous embodiment, the first or the second latch elements are arranged with even circumferential spacing, i.e. the latch elements with even spacing may be provided either on the locking nut or on the plug body. Except for a larger distance, the other latch elements associated with the evenly spaced latch elements are spaced at even but smaller distances from each other. The result is that when the locking nut is rotated, the N latch elements of the locking nut engage, in a staggered sequence, the latch elements of the plug body one after the other.

In the electrical plug connector according to the invention, the angular distance of the evenly distributed latch elements in relation to the virtual center axis of the circumferential surfaces of the locking nut and of the plug body, respectively, is (360°/N) and the smaller even angular distance of the other latch elements is [(360°/N)×(1−1/N)]. When four latch elements each are provided, for example, the angular distance for the evenly distributed latch elements is 90°, and for the complementary latch elements three times the smaller distance of 67.5° and once a larger distance of 157.5°. Due to the special arrangement of the latch elements, 16 latch positions are defined that enclose an angle of 22.5° between each other.

In one embodiment of the electrical plug connector according to the invention, the first latch elements on the locking nut are latch recesses and the second latch elements on the plug body are latch projections. Preferably, the latch recesses and the latch projections mirror each other, with the latch projections being movable in a radial direction relative to the plug body. The second latch elements of the plug body are preferably provided on a latch ring that is mounted rotation-proof on the plug body. In the interest of good spring characteristics, the latch ring is preferably made of metal, specifically spring steel or spring bronze.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
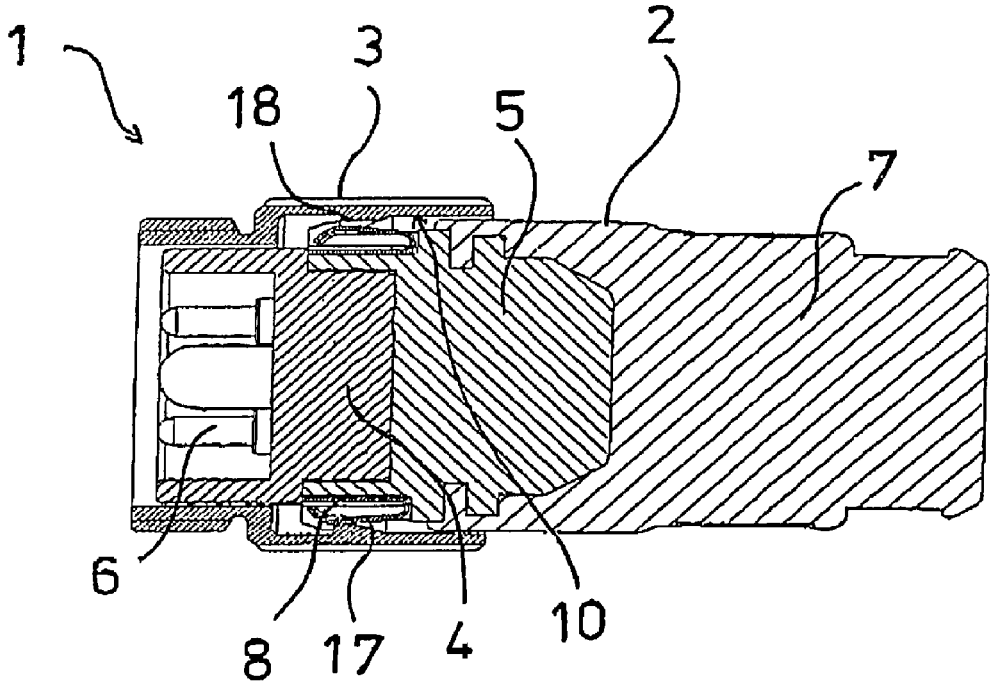
FIG. 1 shows an axial section view of a plug connector according to the invention.
Figure 2:
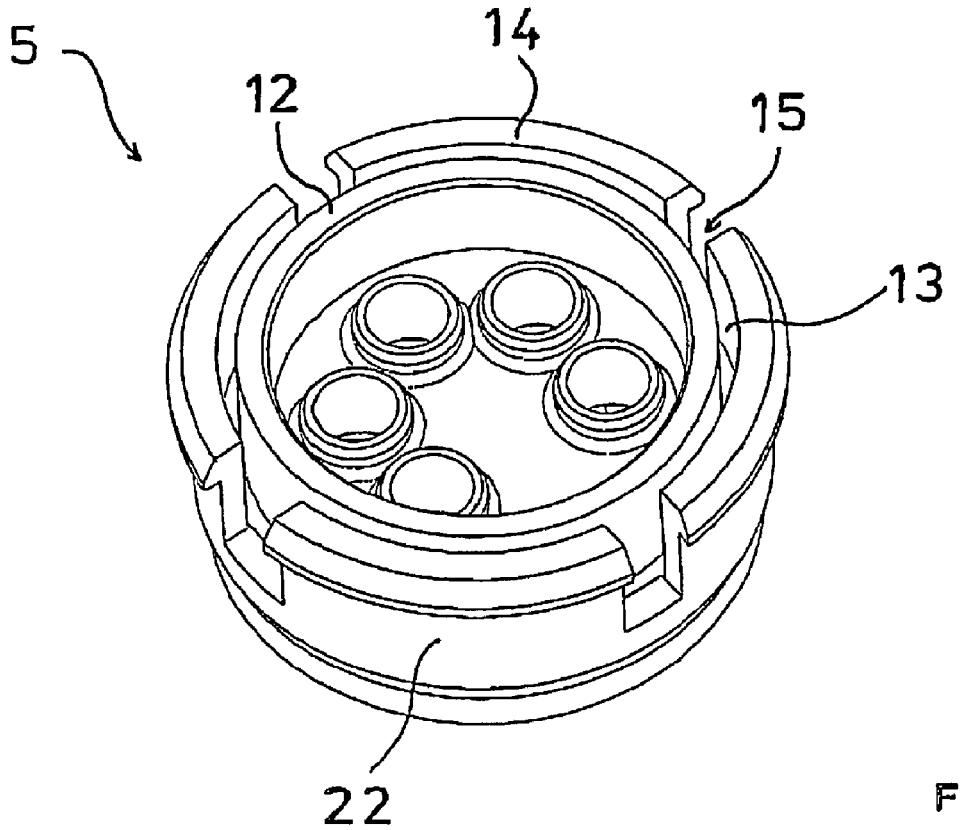
FIG. 2 shows a perspective view of a contact carrier part from FIG. 1.

FIG. 1 shows an electrical plug connector 1 according to the invention with a plug body 2 and with a locking nut 3 that is rotatably attached to the plug body 2. The plug body 2 has a first contact carrier part 4 and a second contact carrier part 5 that hold electrical contacts 6, and a plug cap 7 adjacent to these in rearward direction. The contact carrier parts 4, 5 are detachably connected with each other. In the embodiment example shown in the figure, the plug cap 7 is connected permanently to the second contact carrier part 5 by being molded around it. It is also possible to make the plug cap 7 detachable, and to screw it onto the contact carrier part 5, for example. On the second contact carrier part 5, shown separately in FIG. 2, a latch ring 8 is located. It rests in an annular groove 13 of the contact carrier part 5 on the side facing the contact carrier part 4. The groove 13 is radially defined by an inner sleeve 12 and an outer sleeve 14. The sleeve 14 enclosing the latch ring 8 has notches 15 as passages for the spring arms 9 of the latch ring 8. The latch ring 8 overlaps the inner sleeve 12 on which it supports itself with an inner surface 11. The spring arms 9 that carry at their ends latch elements 17 for engaging latch elements 18 of the locking nut 3 protrude beyond an outer surface 16 of the latch ring 8. With the latch elements 17, the spring arms 9 contact an inner circumferential surface 10 of the locking nut 3 on which the latch elements 18 are formed.

Figure 3:
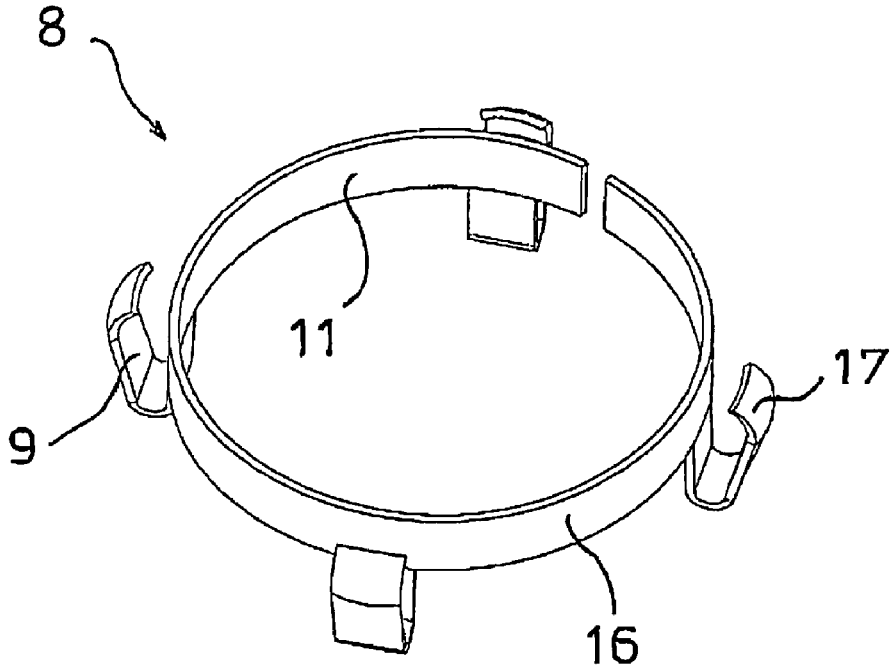
FIG. 3 shows a perspective view of the latch ring from FIG. 1.

On the inner circumferential surface 10 of the locking nut 3, latch recesses 18 are provided as first latch elements, and, as second latch elements, corresponding latch projections 17 are provided on the spring arms 9; in certain positions of the locking nut 3 relative to the plug body 2, the first and second latch elements are able to engage each other. The latch ring 8 shown in FIG. 3 is made of a metallic material with spring action, such as spring steel or spring bronze. In the embodiment example shown in the figures, four each of first latch elements 18 and second latch elements 17 are provided. Correspondingly, the contact carrier part 5 is made with four recesses 15.

Figure 4:
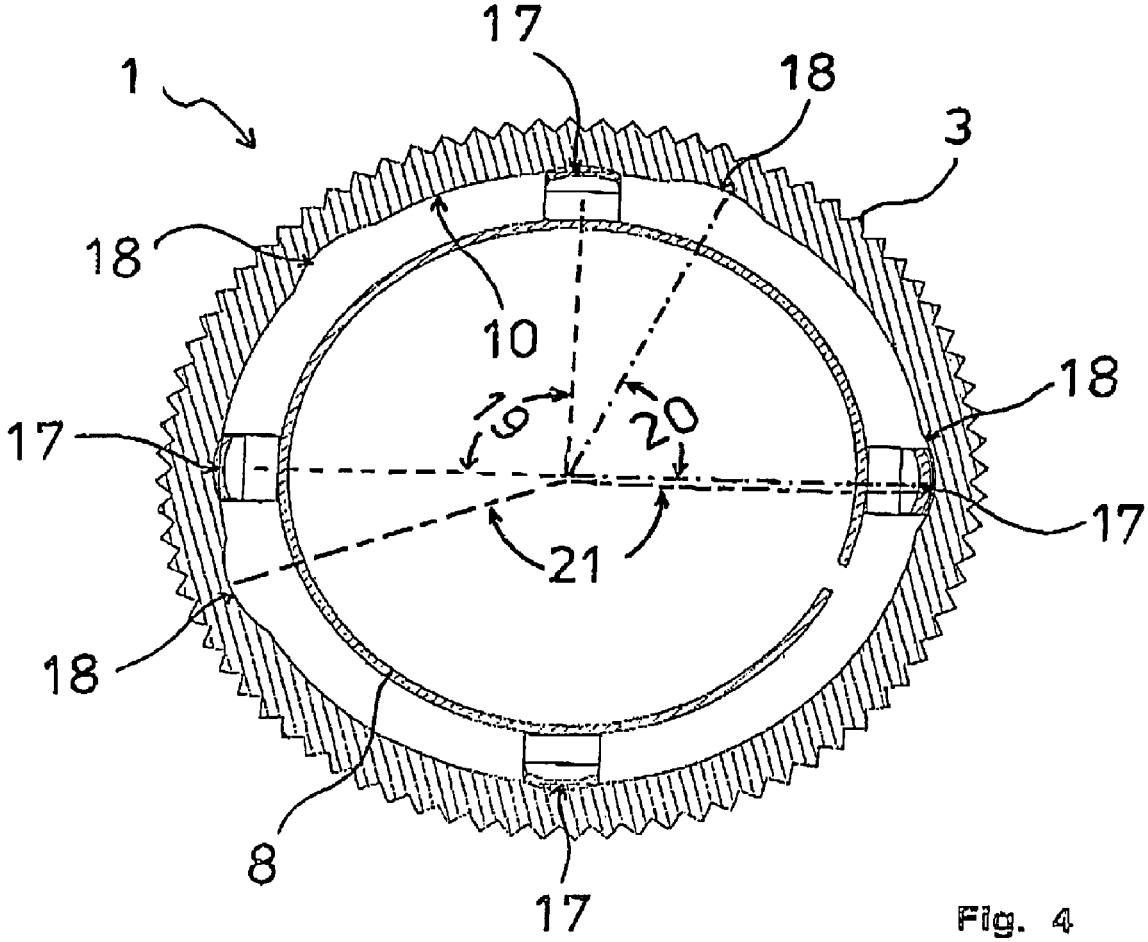
FIG. 4 shows a cross-section view of the plug connector from FIG. 1 in the area of the latch elements.

In the interest of a clearer view, FIG. 4 shows only the locking nut 3 with the latch ring 8. The contact carrier parts 4, 5 and the contacts 6 shown in FIG. 1 are not shown. On an inner circumferential surface 10, the locking nut 3 has four latch recesses 18, and the latch ring 8 has four latch projections 17 on its spring arms 9. In accordance with the spring arms 9, the latch projections 17 have an angular distance 19 of 90° from each other. In contrast, the latch recesses 18 of the locking nut 3 have different angular distances 20, 21. The three smaller angular distances 20 amount to 67.5°, and the larger angular distance 21 amounts to 157.5°. Due to the unequal angular distance 19, 20, 21 of the latch elements 17, 18, a maximum of one each of a latch projection 17 and a latch recess 18 can be made to correspond when the locking nut 3 is rotated. Accordingly, the latch elements 17, 18 can only engage each other in one place of the inner circumferential surface 10, thereby locking the locking nut 3 onto the plug body 2.

FIG. 4 shows one of the locking positions where one of the four latch projections 17 interacts with one of the four latch recesses 18. The three other latch projections 17 of the latch ring 8 contact the inner circumferential surface 10 of the locking nut 3 between the three other latch recesses 18.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

The invention claimed is:

1. An electrical plug connector part with a locking nut that is rotatable relative to a plug body and can be screwed onto an associated matching plug part and that is secured against unintentional rotation relative to the plug body by matched latch elements, where first latch elements are rigid and are molded onto the locking nut, and corresponding second latch elements are mounted rotation-proof and with spring action on the plug body, wherein the locking nut and the plug body have an equal number N of first and second latch elements that are circumferentially spaced from each other and are arranged in sequence in circumferential direction, with the first latch elements having a different angular distance from each other than the second latch element.

2. The plug connector of claim 1, wherein the first and the second latch elements are distributed over their respective circumferential surfaces in such a way that, depending on the position of the locking nut relative to the plug body, no more than one first and one second latch element face each other.

3. The plug connector of claim 1, wherein the N latch elements of the locking nut and of the plug body determine (N×N) latch positions of the plug connector that have the same angular distance of [360°/(N×N)] from each other.

4. The plug connector of claim 1, wherein the first or the second latch elements are arranged with even circumferential spacing, with corresponding latch elements spaced at even but smaller distances from each other, except for one larger distance.

5. The plug connector of claim 4, wherein the angular distance of the evenly distributed latch elements in relation to a virtual center axis of the circumferential surfaces of the locking nut and of the plug body, respectively, is (360°/N) and the smaller even angular distance of the other latch elements (18, 17) is [(360°/N)×(1−1/N)].

6. The plug connector of claim 1, wherein the first latch elements have latch recesses and the second latch elements have latch projections.

7. The plug connector of claim 1, wherein the second latch elements are located on a latch ring.

8. The plug connector of claim 7, wherein the latch ring is made of metal.

9. The plug connector of claim 8, wherein the latch ring is made of spring steel or spring bronze.

* * * * *